US006826992B1

(12) United States Patent
Huang

(10) Patent No.: US 6,826,992 B1
(45) Date of Patent: Dec. 7, 2004

(54) DETACHABLE SAW BLADE GUARD MOUNTING STRUCTURE FOR BENCH SAW

(75) Inventor: Peter Huang, Taichung (TW)

(73) Assignee: Durq Machinery Corp., Taichung (TW)

( * ) Notice: Subject to any disclaimer, the term of this patent is extended or adjusted under 35 U.S.C. 154(b) by 0 days.

(21) Appl. No.: 10/689,046

(22) Filed: Oct. 21, 2003

(51) Int. Cl.[7] ..... B27G 19/02
(52) U.S. Cl. ..... 83/478; 83/544; 83/DIG. 1
(58) Field of Search ..... 83/478, 544, 477.2, 83/DIG. 1

(56) References Cited

U.S. PATENT DOCUMENTS 4,532,841 A * 8/1985 Stackhouse, Jr. ..... 83/102.1
4,614,140 A * 9/1986 Macksoud ..... 83/397
4,721,023 A * 1/1988 Bartlett et al. ..... 83/100
5,231,906 A * 8/1993 Kogej ..... 83/478

* cited by examiner

*Primary Examiner*—Charles Gooman
(74) *Attorney, Agent, or Firm*—Bacon & Thomas PLLC

(57) ABSTRACT

A mounting structure for connecting detachably a saw blade guard to a worktable of a bench saw includes a first connector at the worktable, a second connector at the saw blade guard, and a fastening member for fastening the second connector to the first connector. The first connector has a block member provided with a screw hole. The second connector has a connecting block provided with a through hole and a conical hole, and a cone fitted into the conical hole and having a through hole and a socket fitted onto the block member. The fastening member has a head stopped at one end of the connecting block, and a threaded shank inserted through the through hole of the connecting block and the through hole of the cone and threaded into the screw hole of the block member to lock the second connector to the first connector.

3 Claims, 4 Drawing Sheets

DETACHABLE SAW BLADE GUARD MOUNTING STRUCTURE FOR BENCH SAW

BACKGROUND OF THE INVENTION

1. Field of the Invention

The present invention relates generally to bench saws and, more specifically, to a detachable saw blade guard mounting structure for bench saw.

2. Description of the Related Art

A conventional bench saw, as shown in FIG. 1, is generally comprised of a saw base 1, a worktable 2, a cutting mechanism 3, and saw blade guard 4. In order to prevent scattering of cut chips and ensure safety of the operation of the cutting mechanism 3, the installation of the saw blade guard 4 is necessary and important. The saw blade guard 4 comprises a cover shell 4*a* covering the upper part of the saw blade 3*a* of the cutting mechanism 3 for protection. In order to prevent movement of the saw blade guard 4 relative to the saw blade 3*a* and to reduce space occupation during delivery of the bench saw, the saw blade guard 4 is detachably installed in the bench saw.

Because the aforesaid bench saw is a wood cutting-working apparatus, the fixation and safeness of the parts of the bench saw must on assembly and design must be reinforced. However, in actual application of the aforesaid bench saw, there are unexpected dangers in hiding. For example, the cover shell 4*a* of the saw blade guard 4 has a mounting plate 4*b* extended from its one end and detachably fastened to the worktable 2 by a screw rod (not shown), which is inserted through a block (not shown) at one end of the mounting plate 4*b* and threaded into a screw hole (not shown) at one side of the worktable 2. This saw blade guard mounting arrangement is not safe. If the saw blade guard 4 is hit by an external object accidentally during working of the cutting mechanism 3, the cover shell 4*a* may be biased to touch the saw blade 3*a*, and an accident may occur at this time.

Therefore, it is desirable to provide a detachable saw blade guard mounting structure for bench saw that eliminates the aforesaid problem.

SUMMARY OF THE INVENTION

It is the main object of the present invention to provide a detachable saw blade guard mounting structure for bench saw, which provides a high locking force to the saw blade guard, preventing biasing of the saw blade guard upon an impact force.

It is another object of the present invention to provide a detachable saw blade guard mounting structure for bench saw, which enhances the locking between parts by means of conical contact.

To achieve these objects of the present invention, the detachable saw blade guard mounting structure is used for connecting detachably a saw blade guard to a worktable of a bench saw. The mounting structure comprises a first connector disposed at the worktable, a second connector disposed at the saw blade guard, and a fastening member for fastening the second connector to the first connector. The first connector has a non-circular block member disposed at one side of the worktable and a screw hole axially extended through the non-circular block member. The second connector has a connecting block fixedly disposed at a mounting plate of the saw blade guard and provided with a through hole and a conical hole axially aligned at one end of the through hole of the connecting block, and a cone fitted into the conical hole of the connecting block. The cone has a through hole and a socket disposed at one end of the through hole of the cone and fitted onto the non-circular block member. The fastening member has a head stopped at one end of the connecting block, and a threaded shank inserted through the through hole of the connecting block and the through hole of the cone and threaded into the screw hole of the block member to lock the second connector to the first connector.

DETAILED DESCRIPTION OF THE INVENTION

A bench saw to which the invention pertains comprises a saw base, a worktable disposed at the top side of the saw base, a cutting mechanism disposed at the worktable, the cutting mechanism comprising a saw blade, and a saw blade guard detachably mounted on the worktable and covering a part of the saw blade. The main features of the present invention are at the mounting arrangement between the saw blade guard and the worktable. These features are outlined hereinafter with reference to FIGS. 2–4.

Figure 1:
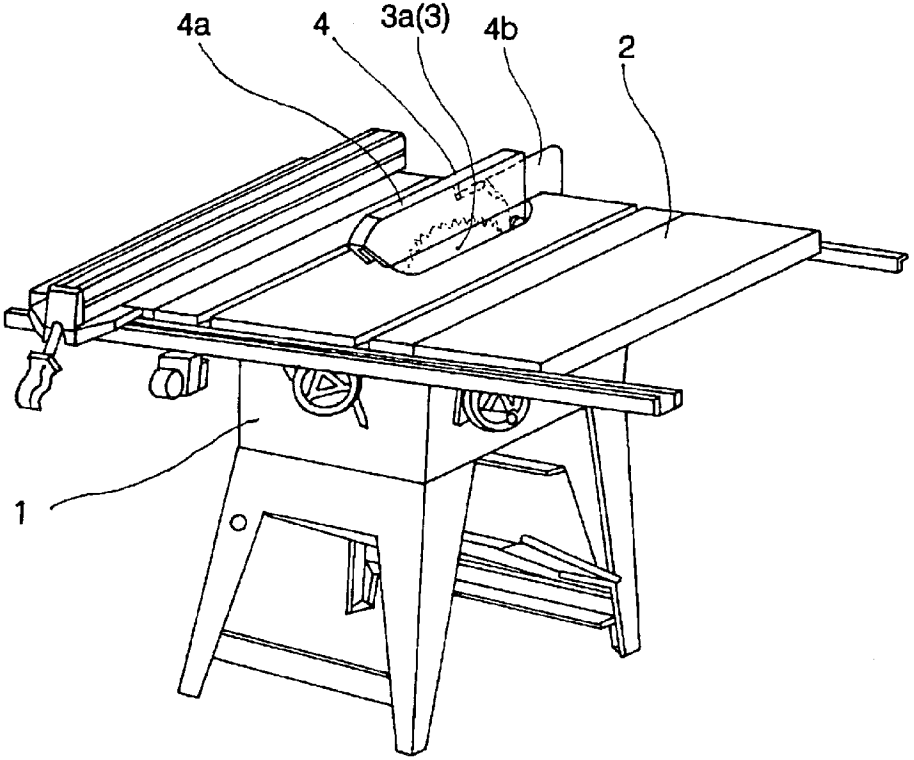
FIG. 1 PRIOR ART
FIG. 1 is a schematic perspective view of a bench saw according to the prior art.
Figure 2:
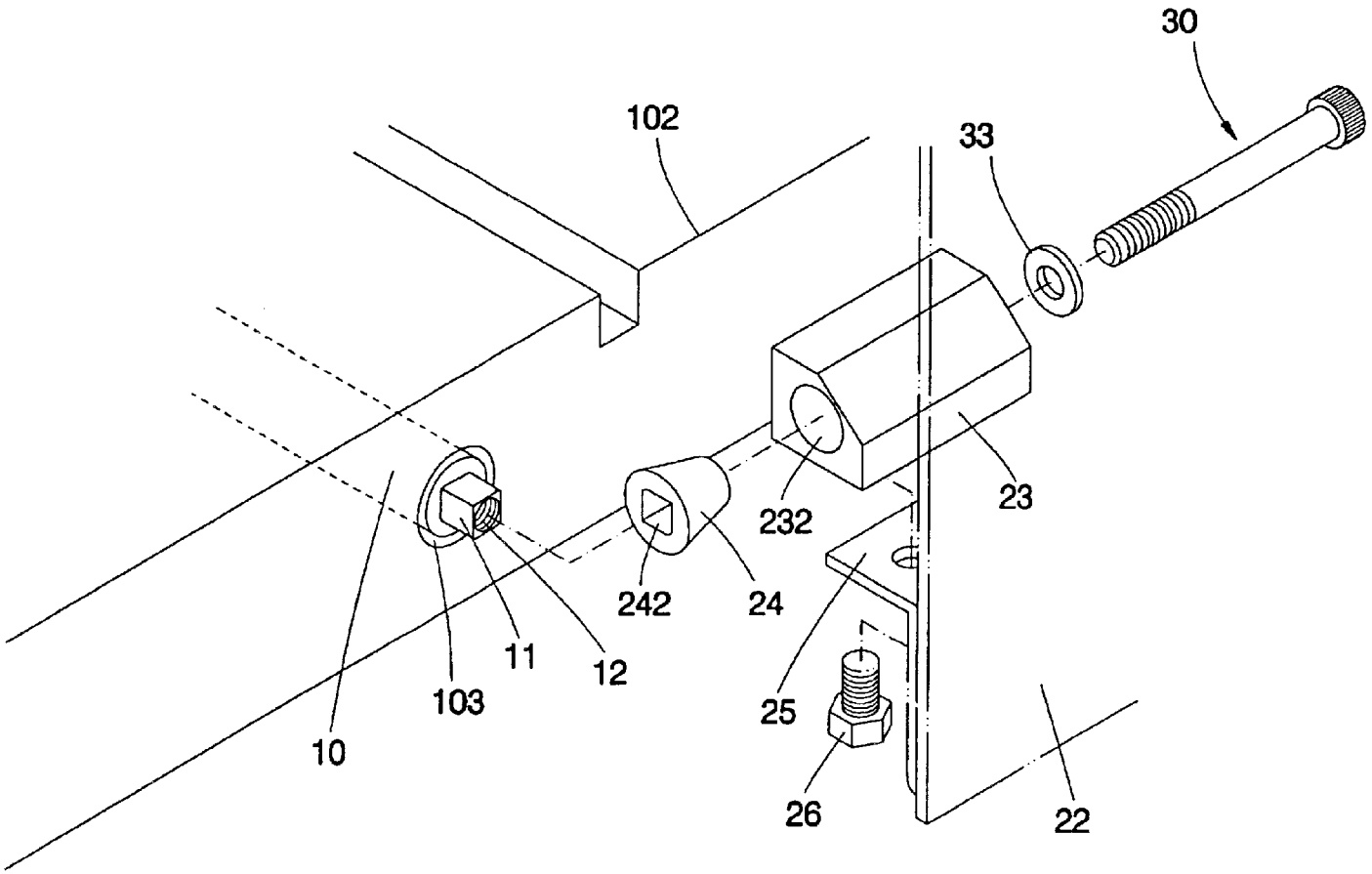
FIG. 2 is an exploded view of a detachable saw blade guard mounting structure for bench saw according to the present invention.
Figure 3:
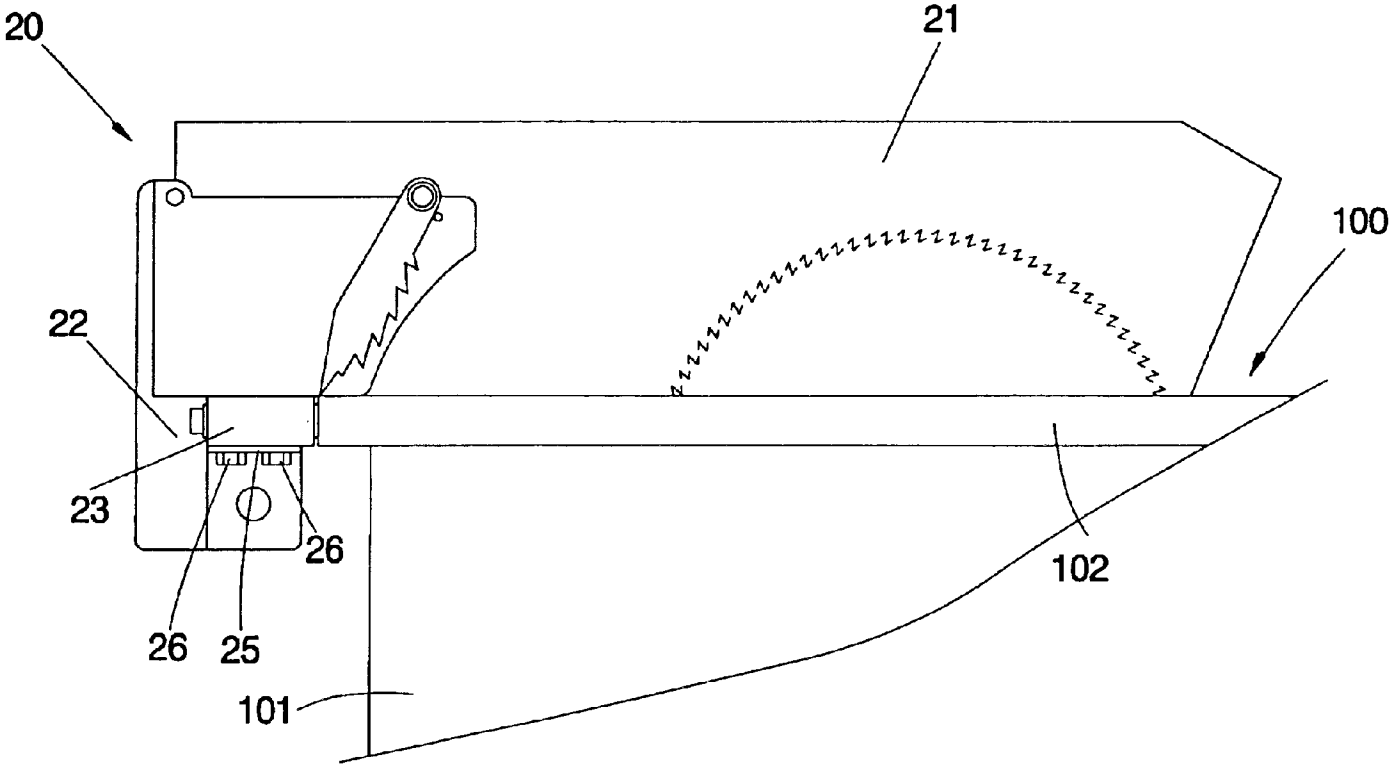
FIG. 3 is a schematic drawing showing the detachable saw blade guard mounting structure installed in a bench saw according to the present invention.
Figure 4:
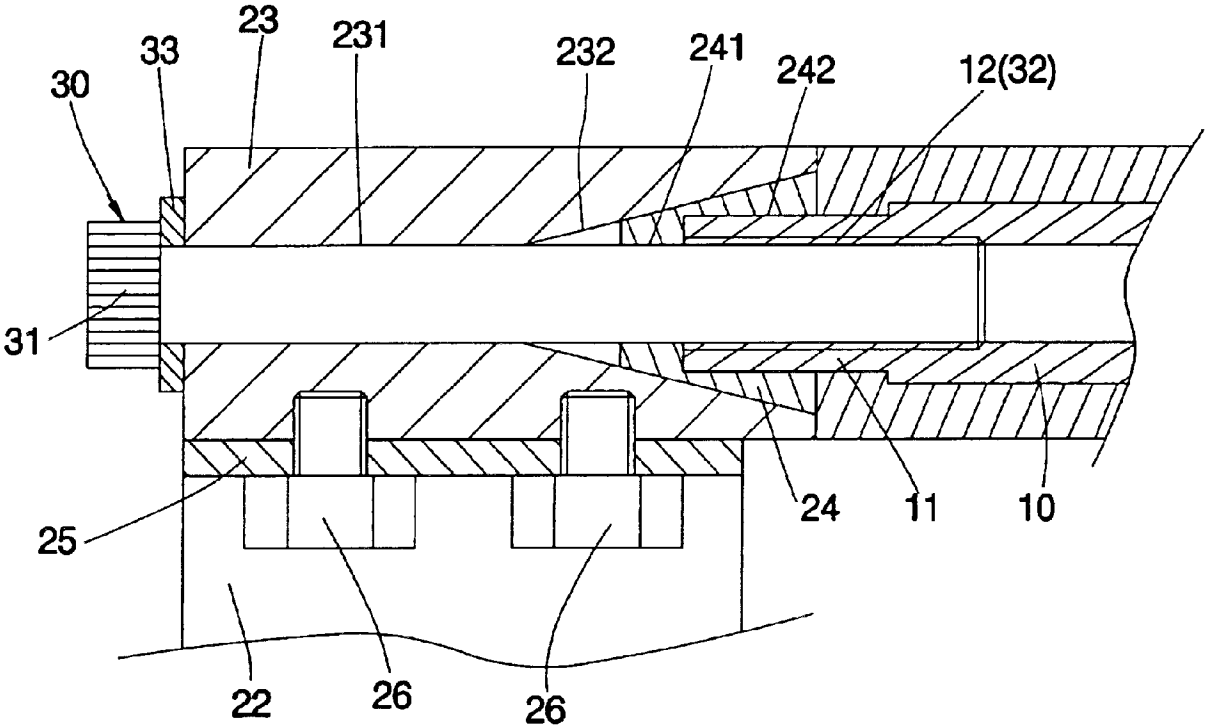
FIG. 4 is a sectional assembly view of the detachable saw blade guard mounting structure according to the present invention.

As illustrated in FIGS. 2–4, the bench saw 100 comprises a transverse rod 10 horizontally transversely mounted in the saw base 101 below the surface 102 of the saw base. The transverse rod 10 has one end extended out of a circular side hole 103 at the worktable 10 and terminating in a rectangular end block 11, and a screw hole 12 axially extended through the rectangular end block 11. The rectangular end block 11 and the screw hole 12 form a first connector.

The saw blade guard 20 is comprised of a cover shell 21, a mounting plate 22, a connecting block 23, and a cone 24. The cover shell 21 is fastened pivotally with the mounting plate 22. The mounting plate 22 comprises a horizontal lug 25. Two screws 26 are inserted through the horizontal lugs 25 and threaded into the bottom wall of the connecting block 23 to lock the connecting block 23 to the mounting plate 22.

Further, the connecting block 23 and the cone 24 form a second connector matching the aforesaid first connector. As shown in FIG. 4, the connecting block 23 has a through hole 231 axially extended through the two ends, and a conical hole 232 concentrically formed in one end of the through hole 231. The conical hole 232 has a diameter gradually increasing from the through hole 231 toward the outside of the connecting block 23. The cone 24 has a reduced outer diameter inserted into the conical hole 232 of the connecting block 23. The conical outer wall of the cone 24 fits the conical periphery of the conical hole 232. The cone 24 has a through hole 241 axially extended through the two ends and a socket 242 disposed at one end of the through hole 241. The socket 242 is a rectangular hole fitting the rectangular end block 11 of the transverse rod 10. When the socket 242 attached to the rectangular end block 11, the cone 24 is prohibited from rotary motion relative to the transverse rod 10.

A fastening member 30 is used to lock the aforesaid second connector (the connecting block 23 and the cone 24) to the aforesaid first connector (the rectangular end block 11 and the screw hole 12). According to this embodiment, the fastening member 30 is a screw bolt, having a head 31 and a threaded shank 32. The threaded shank 32 is inserted through a washer 33 into the through hole 231 of the connecting block 23 and the through hole 241 of the cone 24 and then threaded into the screw hole 12 at the transverse rod 10, keeping the head 31 stopped against one end of the connecting block 23. When continuously rotating the fastening member 30 after the head 31 has been stopped at one end of the connecting block 23, the cone 24 is forced toward the inside of the connecting block 23 and at the same time the connecting block 23 is forced toward the transverse rod 10, and therefore the connection between the first connector and the second connector is tightened, i.e., the saw blade guard 20 is firmly secured to the worktable 102.

After description of the structural arrangement of the present invention, the advantages and effects of the present invention are outlined hereinafter:

1. As shown in FIG. 4, in addition the engagement between the threaded shank 32 of the fastening member 30 and the screw hole 12 of the transverse rod 10 to secure to the saw blade guard 20 to the worktable 102, the arrangement of the cone 24 between the connecting block 23 and the rectangular end block 11 produces components of force during movement of the connecting block 23 toward the transverse rod 10 by force, enhancing the engagement between the connecting block 23 and the transverse rod 10 and, preventing biasing of the saw blade guard 20 upon an external impact force. Therefore, the invention improves the safeness of the bench saw.

2. As indicated above, after connection of the cone 24 to the rectangular end block 11 of the transverse rod 10, the conical hole 232 of the connecting block 23 is attached to the cone 24 at the rectangular end block 11 of the transverse rod 10, keeping the mounting plate 22 quickly and perpendicularly secured to the worktable 102. When tightened the fastening member 30, the mounting plate 22 of the saw blade guard 20 is locked to the worktable 102. Therefore, the installation of the present invention is easy and rapid.

3 When loosened the fastening member 30 from the screw hole 12, the saw blade guard 20 can be removed from the worktable 102 and separately packed for delivery to minimize the storage space of the bench saw.

What is claimed is:

1. A mounting structure for connecting detachably a saw blade guard to a worktable of a bench saw, said mounting structure comprising:

a first connector fixedly disposed at said worktable, said first connector having a non-circular block member and a screw hole axially extended through said non-circular block member;

a second connector fixedly disposed at said saw blade guard, said second connector having a connecting block provided with a through hole and a conical hole axially aligned at one end of the through hole of said connecting block, and a cone fitted into the conical hole of said connecting block, said cone having a through hole and a socket disposed at one end of the through hole of said cone and fitted onto said non-circular block member; and a fastening member having a head stopped at one end of said connecting block, and a threaded shank inserted through the through hole of said connecting block and the through hole of said cone and threaded into said screw hole of said first connector to lock said second connector to said first connector.

2. The mounting structure as claimed in claim 1, wherein said non-circular block member of said first connector is a rectangular end block formed integral with one end of a fixed transverse rod in said worktable and extended out of one side of said worktable; said socket of said cone is a rectangular hole coupled to said rectangular end block to prohibit said cone from rotary motion relative to said fixed transverse rod.

3. The mounting structure as claimed in claim 2, wherein said conical hole has a diameter gradually increasing from the through hole of said connecting member toward the outside of said connecting member; said cone has a reduced outer diameter inserted into the conical hole of said connecting block.

* * * * *